US007160141B2

(12) United States Patent
Marshall et al.

(10) Patent No.: US 7,160,141 B2
(45) Date of Patent: Jan. 9, 2007

(54) LOW-PROFILE, HIGH SPEED, BOARD-TO-BOARD CONNECTOR SYSTEM

(75) Inventors: Robert E. Marshall, Elizabethtown, PA (US); Hung Viet Ngo, Harrisburg, PA (US); Craig C. Clewell, Harrisburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/973,468

(22) Filed: Oct. 26, 2004

(65) Prior Publication Data

US 2006/0089011 A1 Apr. 27, 2006

(51) Int. Cl.
*H01R 13/58* (2006.01)

(52) U.S. Cl. ..... 439/451.5; 439/79

(58) Field of Classification Search ..... 439/451.5, 439/79

See application file for complete search history.

(56) References Cited

U.S. PATENT DOCUMENTS

| | | | | |
|---|---|---|---|---|
| 4,469,387 | A * | 9/1984 | McHugh | 439/140 |
| 5,336,109 | A * | 8/1994 | Hillbish et al. | 439/541.5 |
| 5,876,222 | A | 3/1999 | Gardner et al. | 439/79 |
| 5,984,698 | A | 11/1999 | Hirata | 439/101 |
| 6,159,040 | A | 12/2000 | Chang et al. | 439/541.5 |
| 6,179,629 | B1 | 1/2001 | Lai et al. | 439/79 |
| 6,183,270 | B1 | 2/2001 | Huang et al. | 439/79 |
| 6,190,183 | B1 | 2/2001 | Yang et al. | 439/79 |
| 6,287,146 | B1 | 9/2001 | Avery et al. | 439/607 |
| 6,612,867 | B1 | 9/2003 | Wu | 439/541.5 |
| 6,699,068 | B1 | 3/2004 | Wu | 439/541.5 |
| 6,736,676 | B1 | 5/2004 | Zhang et al. | 439/607 |

OTHER PUBLICATIONS

Z-Dok Adapter Board Connector Assembly, 32 Signal Diff. Pair, 2 Utility Contacts per Side, Tyco Electronics, 1 page.
Plateau HS Dock™ Floating Connector, Molex Incorporated, 4 pages.
U.S. Appl. No. 09/919,321, filed Jul. 31, 2001, Johnescu.
U.S. Appl. No. 10/779,172, filed Feb. 11, 2004, Johnescu.

* cited by examiner

*Primary Examiner*—Truc Nguyen
(74) *Attorney, Agent, or Firm*—Woodcock Washburn LLP

(57) ABSTRACT

A high speed electrical connector is disclosed. The electrical connector includes a plug portion and a receptacle portion. The plug portion has a first plurality of signal contacts contained in a plug back housing. The receptacle portion is adapted to mate with plug portion and has a second plurality of signal contacts in a receptacle back housing. The plug back housing is adapted to contain the first plurality of signal contacts for both surface mount and thru-hole termination and the receptacle back housing is adapted to contain the second plurality of signal contacts for both surface mount and thru-hole termination.

21 Claims, 14 Drawing Sheets

LOW-PROFILE, HIGH SPEED, BOARD-TO-BOARD CONNECTOR SYSTEM

FIELD OF THE INVENTION

Generally, the invention relates to the field of electrical connectors. More particularly, the invention relates to low profile, low cost, high speed, board-to-board connector systems.

BACKGROUND OF THE INVENTION

Electrical connectors are designed to meet numerous industry or customer demands. One of those demands is that electrical connectors be compact, while still achieving certain electrical requirements. One design characteristic that customers of electrical connectors typically demand is that the connector have a low profile. A connector's profile may also be described as the connector height or pitch. A common design specification demanded by consumers of electrical connectors is that the connector have a pitch or profile less than 25 mm. The profile or height of a connector is oftentimes important because the lower the profile, the more space may be saved for other devices. An increase in the number of devices may increase the performance or functionality of the overall device.

Low profile devices may be used, for example, in the telecommunications industry, or for applications, such as, for example, mid to high end servers, enterprise switching, storage networks and/or extender cards.

Consequently, there is a need for a low cost, low profile, board-to-board connector system.

SUMMARY OF THE INVENTION

The present invention overcomes the aforementioned needs by providing a low profile, low cost, board-to-board connector system. In particular, in one embodiment, the present invention provides a connector system that can use the same back housing for both surface mount or thru-hole termination to a printed circuit board. In this manner, rather than manufacturing different back housings depending on the method of termination, manufacturing time and costs may be reduced because only one back housing need be produced.

In one embodiment of the present invention, a high speed electrical connector includes a plug portion and a receptacle portion. The plug portion includes signal contacts contained in a plug back housing. The receptacle portion, which is adapted to mate with the plug portion, also includes signal contacts in a receptacle back housing. The plug back housing is designed such that the same plug back housing may contain signal contacts for either surface mount and thru-hole termination. Also, the receptacle back housing is designed such that the same receptacle back housing may contain signal contacts for either surface mount and thru-hole termination.

BRIEF DESCRIPTION OF THE DRAWINGS

The invention is further described in the detailed description that follows, by reference to the noted drawings by way of non-limiting illustrative embodiments of the invention, in which like reference numerals represent similar parts throughout the drawings, and wherein.

DETAILED DESCRIPTION OF ILLUSTRATIVE EMBODIMENTS

Certain terminology may be used in the following description for convenience only and should not be considered as limiting the invention in any way. For example, the terms "top," "bottom," "left," "right," "upper," and "lower" designate directions in the figures to which reference is made. Likewise, the terms "inwardly" and "outwardly" designate directions toward and away from, respectively, the geometric center of the referenced object. The terminology includes the words above specifically mentioned, derivatives thereof, and words of similar import.

Figure 1:
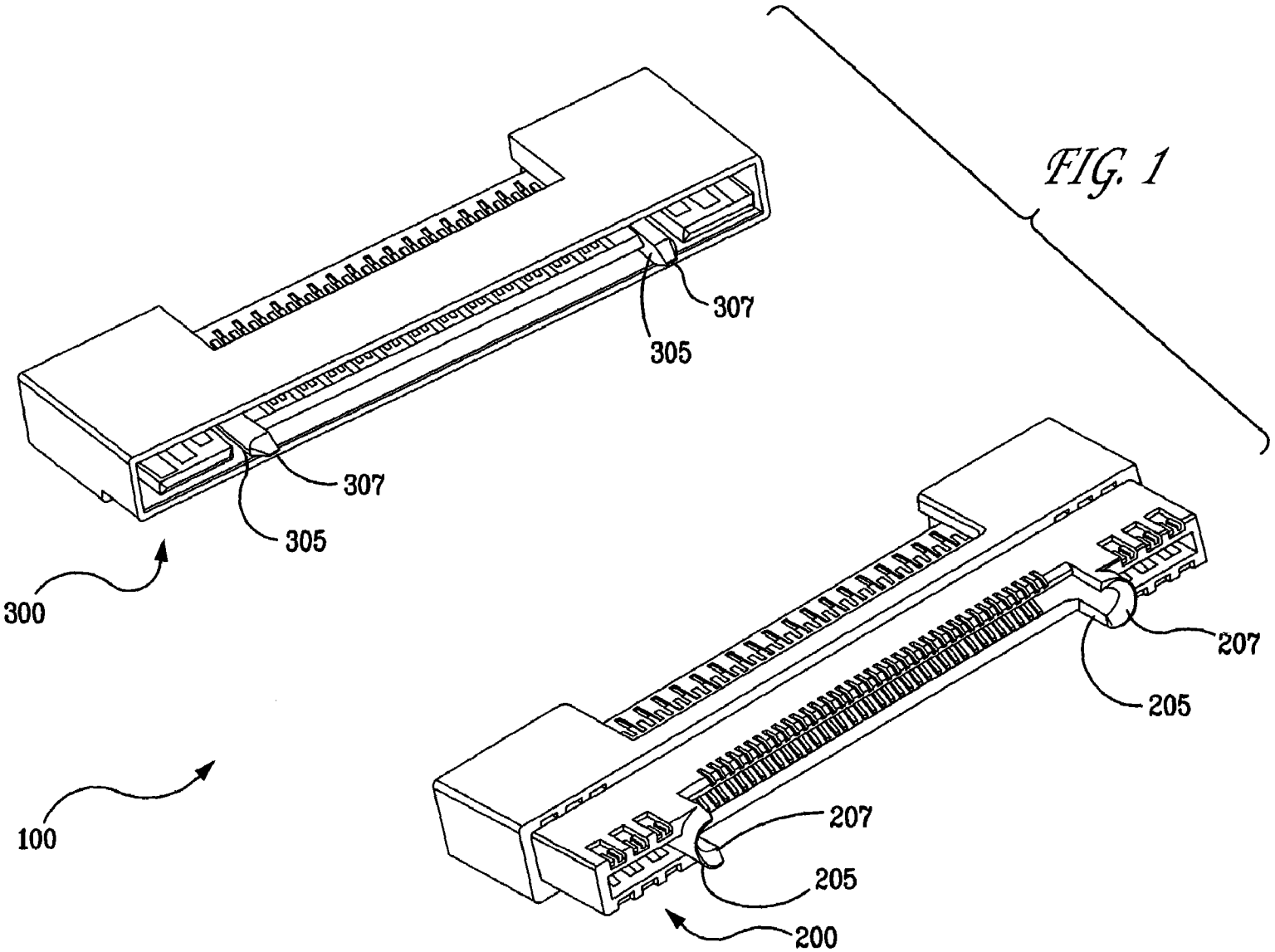
FIG. 1 shows one embodiment of a board-to-board connector system according to the invention.

FIG. 1 shows one embodiment of a board-to-board connector system 100 according to the invention. The board-to-board connector system can include a receptacle portion 200 and a plug portion 300. The receptacle 200 and the plug 300 are mateable to one another. In one embodiment, as shown in FIG. 1, plug 300 may include alignment pins 305. Alignment pins 305 are adapted to mate with alignment sockets 205 contained on receptacle 200. Alignment pins 305 can include a chamfered tip 307. Also, the alignment socket 205 can include complementary chamfered ends 207. By chamfering socket 205 and alignment pins 305, the plug portion 300 and receptacle portion may be more easily mateable by allowing for a degree of misalignment. Receptacle 200 and plug 300 may be mated using many techniques known in the art without departing from the invention.

Figure 2:
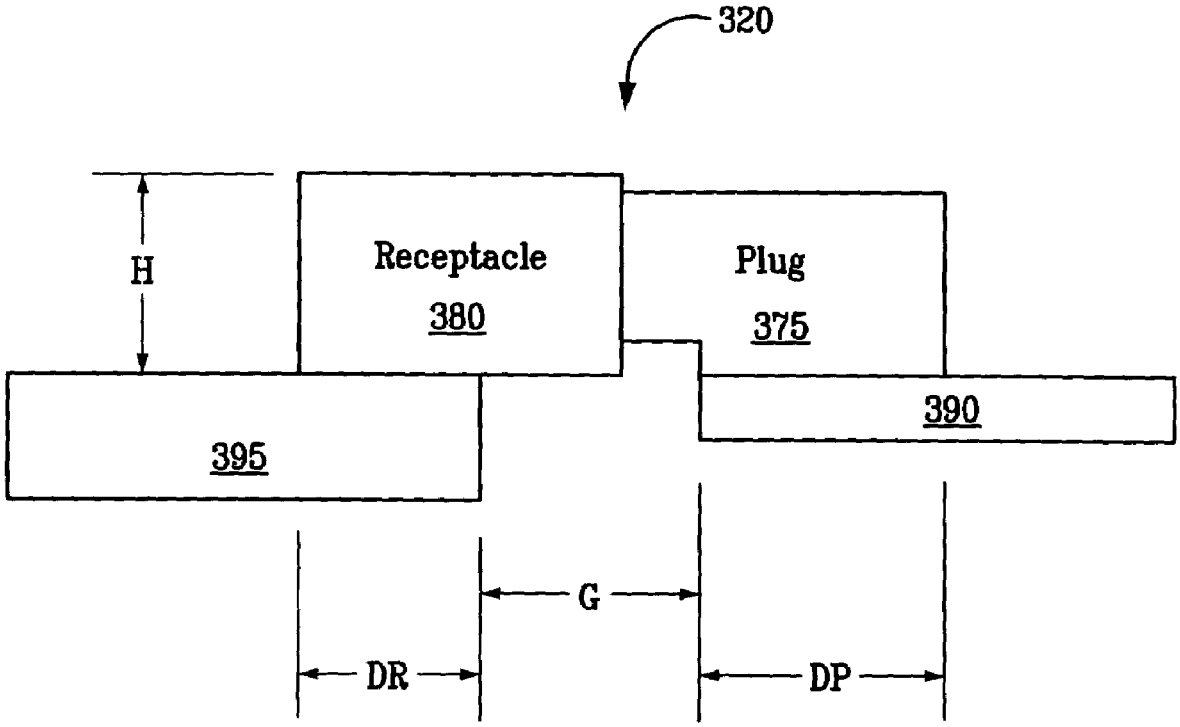
FIG. 2 shows one configuration of a board-to-board connector system according to the invention.

FIG. 2 shows one configuration of a board-to-board connector system according to the invention. In this configuration, the receptacle 380 and plug 375 may be used in a co-planar configuration. Specifically, receptacle 380 and plug 375 are electrically mated. Receptacle 380 may be electrically connect to printed circuit board 395 and plug 375 may be electrically connect to printed circuit board 390. In this configuration, printed circuit board 395 and printed circuit board 390 are co-planar.

In the co-planar configuration, design specifications for the plug 375 and the receptacle 380 may be customized for particular applications. For example, as shown, distance H represents the maximum height of the connector 320 or the distance from the top of printed circuit board 395 to the top of the connector 320. Also shown, distance G may represent the distance between printed circuit board 395 and printed circuit board 390 after mating the plug 375 and the receptacle 380. Distance DR may represent the maximum outward distance the receptacle 380 extends along board 395. Similarly, distance DP represent the maximum outward distance the plug 375 extends along board 390. As stated above, these distances may be customized for a particular application and may be changed without departing from the invention.

Figure 3:
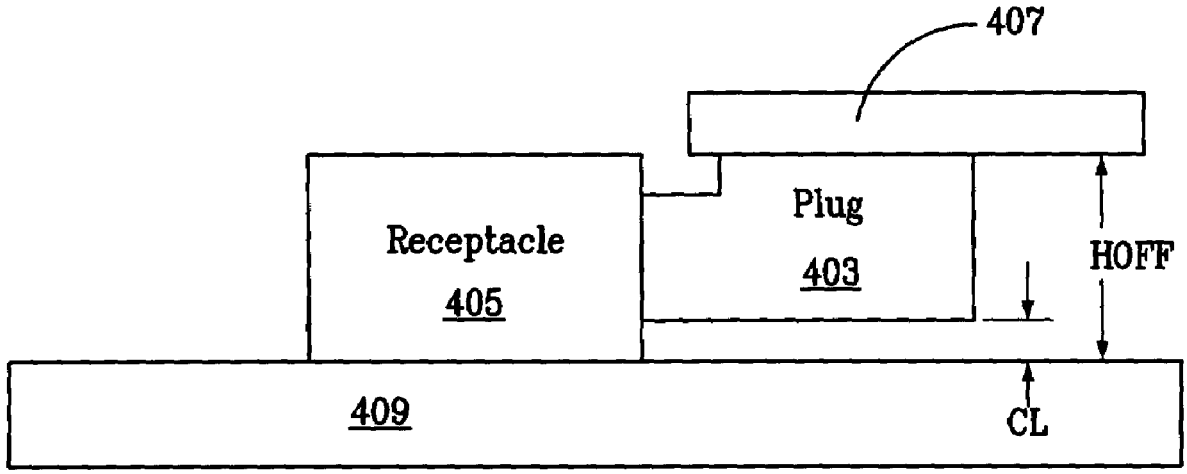
FIG. 3 shows another configuration of a board-to-board connector system according to the invention.

FIG. 3 shows another configuration of a board-to-board connector system according to the invention. In this configuration, the receptacle 380 and plug 375 may be used in an offset co-planar configuration. Specifically, once plug 403 and receptacle 405 are electrically mated and plug 403 is electrically mated to printed circuit board 407 and receptacle 405 is electrically mated to printed circuit board 409, printed circuit boards 407 and 409 are in an offset co-planar configuration.

In the offset co-planar configuration, design specifications for the plug 403 and the receptacle 405 may be customized for particular applications. For example, distance HOFF represents the maximum board offset distance or the distance between the bottom edge of printed circuit board 407 and the top edge of printed circuit board 409. Also, distance CL represents the minimum clearance between printed circuit board 409 and plug 403 or the distance between the top of printed circuit board 409 and the bottom of plug 403. As stated above, these distances may be customized for a particular application and may be changed without departing from the invention.

Figure 4:
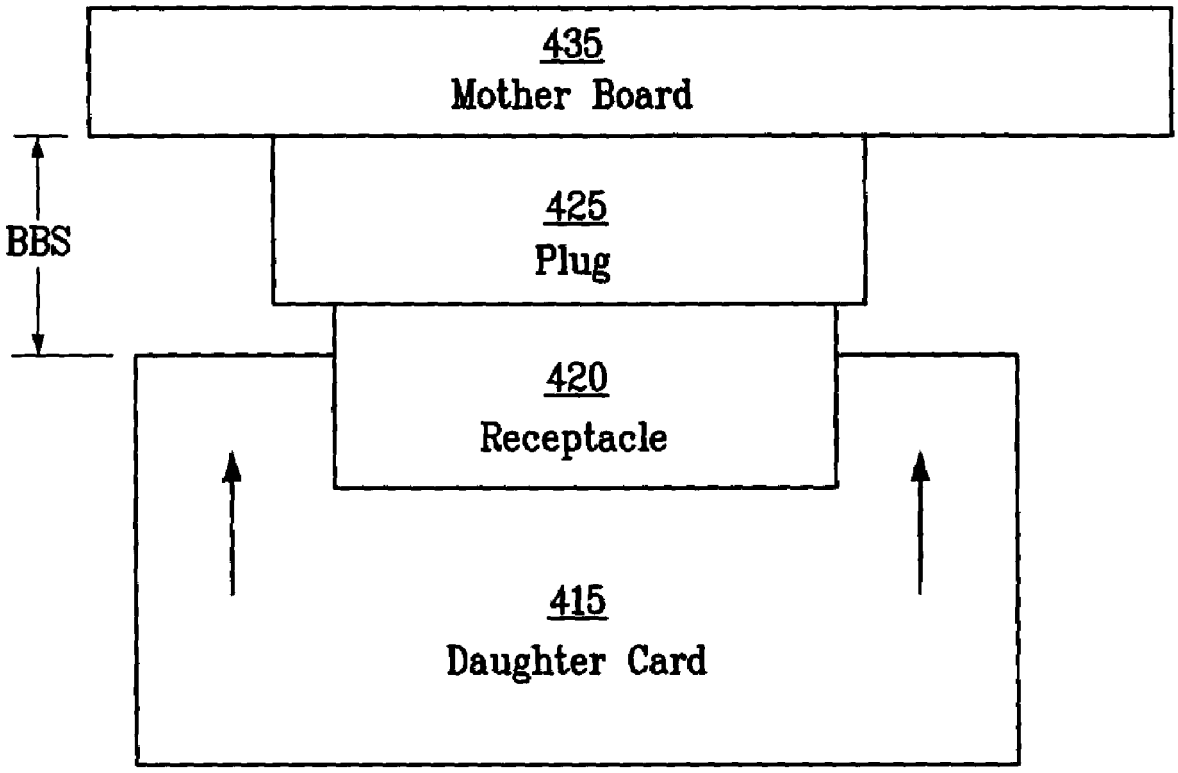
FIG. 4 shows another configuration of a board-to-board connector system according to the invention.

FIG. 4 shows another configuration of a board-to-board connector system according to the invention. In this configuration, the receptacle 420 and plug 425 may be used in a backplane configuration. A backplane may be defined as a circuit board containing sockets into which other circuit boards may be plugged in. Once receptacle 420 and plug 425 are electrically mated and plug 425 is electrically connected to printed circuit board or mother board 435 and receptacle 420 is electrically connected to printed circuit board or daughtercard 415, the daughtercard 415 and motherboard 435 are configured in a backplane manner or with daughtercard 425 roughly positioned in a perpendicular manner to motherboard 435.

In the backplane configuration, design specifications for the plug 425 and the receptacle 420 may be customized for particular applications. For example, distance BBS can represent the minimum or maximum board-to-board distance or the minimum or maximum distance between the top of daughtercard 415 and the bottom of motherboard 435. As stated above, these distances may be customized for a particular application and may be changed without departing from the invention.

Figure 5A:
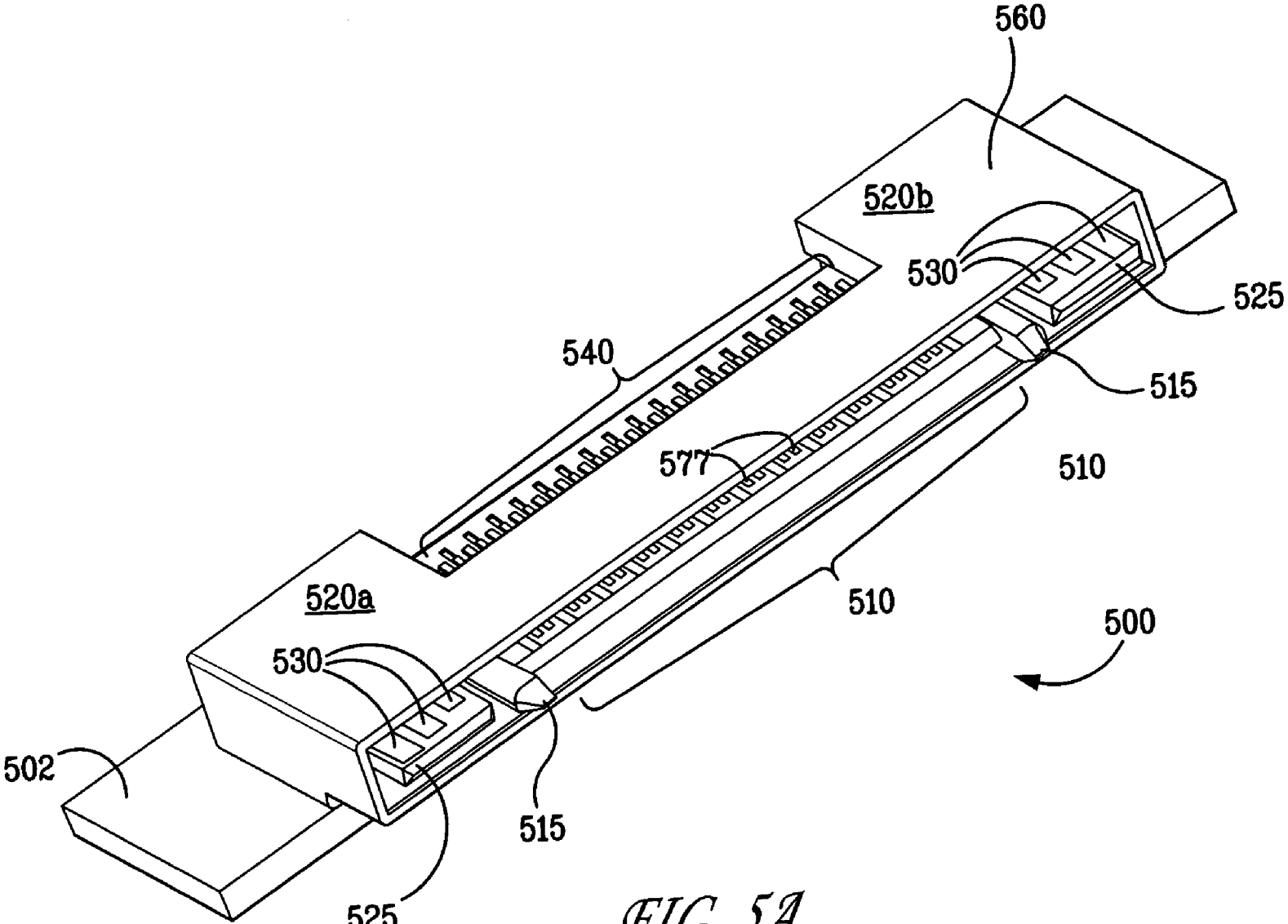
FIG. 5A shows one embodiment of a plug portion of a board-to-board connector system according to the invention.

FIG. 5A shows one embodiment of a plug portion of a board-to-board connector system according to the invention. As shown, plug portion 500 may be attached to a printed circuit board 502. Plug portion 500 may include a main housing 560. Main housing can include power module sections 520A and 520B and a high speed contact section 540.

Power module sections 520A and 520B can include utility contacts 530 positioned adjacent to a dielectric material 525. In this manner, utility contacts 530 may be positioned on each side of dielectric material 525. As shown, each power module section 520A and 520B can include three utility contacts 530 positioned on the top of the dielectric 525 and three utility contacts (not shown) on the bottom of the dielectric 525. Therefore, in one embodiment of the invention, the board to board connector system can include twelve utility contacts. In one embodiment of the invention, the utility contacts may be used for electrostatic discharge purposes, power grounds or the like. It should be understood, however, that the system may include any number of utility contacts without departing from the invention. High speed contact section 540 contains high speed contacts 577 for providing electrical communication with a receptacle portion (not shown).

Plug portion 500 may also include, as shown in FIG. 5A, alignment pins 510 attached to the main housing 560. Alignment pins 510 can include a chamfered tip 515 to aid the plug portion 500 when mating with a receptacle portion (not shown).

Figure 5B:
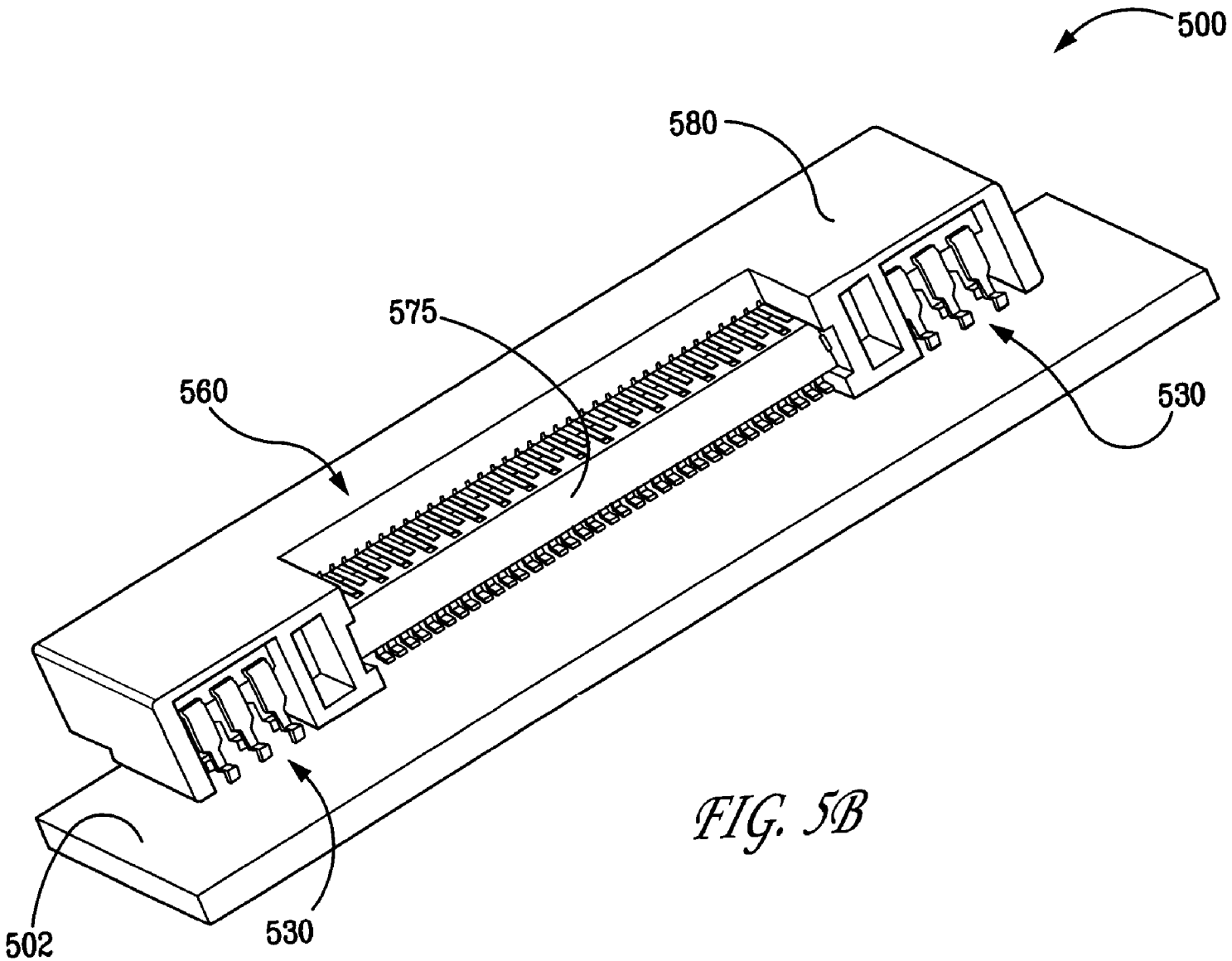
FIG. 5B shows a backview of the plug portion of FIG. 5A.

FIG. 5B shows a backview of the plug portion of FIG. 5A. As shown, in addition to the main housing 560, plug 500 can include a back housing 575. Back housing 575 can be used to secure the high speed contacts 580 within the main housing 560 of the plug 500. As shown, in this particular embodiment, the plug includes 24 differential pair high speed contacts 580. However, any number of high speed contacts may be used without departing from the invention.

Figure 6:
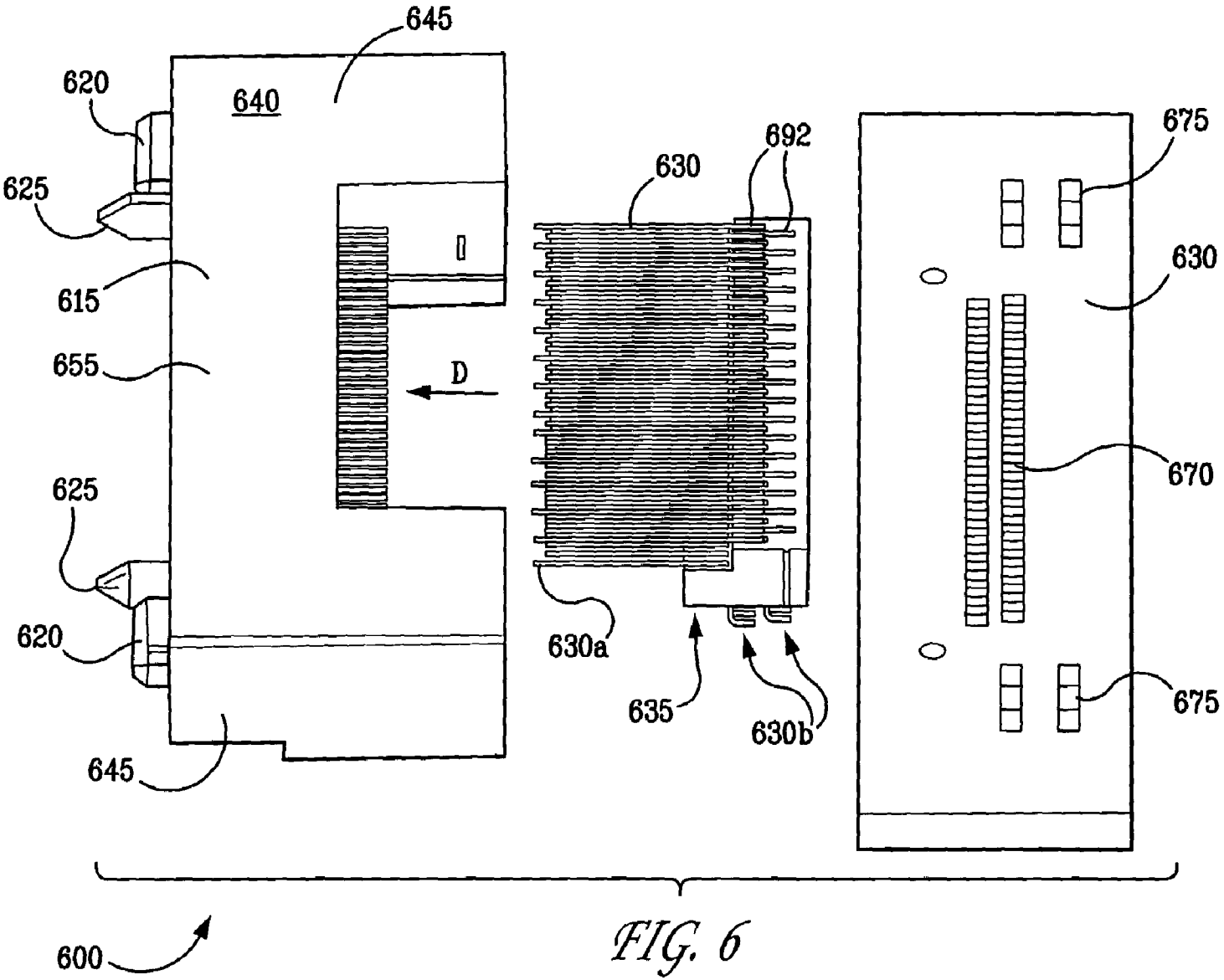
FIG. 6 shows one embodiment of a plug portion of a board-to-board connector system according to the invention adapted for surface mount termination.

FIG. 6 shows one embodiment of a plug portion of a board-to-board connector system according to the invention adapted for surface mount termination. As shown, the plug portion 600 includes a main housing 640 and a back housing 635. As stated above, the main housing can include a power module sections 645 and a high speed contact section 655. The main housing can include alignment pins 625 and a dielectric material 620 for utility contacts (not shown).

The back housing 635 is adapted to secure the high speed contacts 630 within the main housing 640. In this manner, the high speed contacts 630 can be inserted into the back housing 635. In one embodiment, the back housing contains apertures or slots 692 in the housing through which the signal contacts 630 extend. The high speed contacts 630 can have one end 630A arranged in two rows and adapted for mating with complementary signal contacts in the receptacle portion (not shown) of the system. Any number of rows of contacts may be used without departing from the invention. Once the signal contacts 630 are secured in the back housing 635, the back housing 635 can be inserted into the main housing 640 by inserting the back housing 635 along direction D.

The high speed contacts 630 can also have end 630B arranged in two rows and adapted for surface termination on printed circuit board 636. Any number of rows of contacts may be used without departing from the invention. As shown, the printed circuit board 636 may have signal pads 670 thereon such that electrical communication between the board 636 and the signal contacts 630 can be maintained. The printed circuit board 636 can also include utility contact pads 675 for surface termination thereon such that electrical communication is established between the utility contacts (not shown) on plug 600 and the printed circuit board 636.

As can be seen in FIG. 6, the back housing 635 contains more slots 692 than necessary to provide a two row surface mount termination to board 630. In this manner, back housing 635 may be used to in a different plug for a different connector that provides a different configuration or termination. Consequently, manufacturing costs may be reduced by providing a single back housing that can be used in different applications. For example, back housing 635 may be used in a plug like that shown in FIG. 7.

Figure 7:
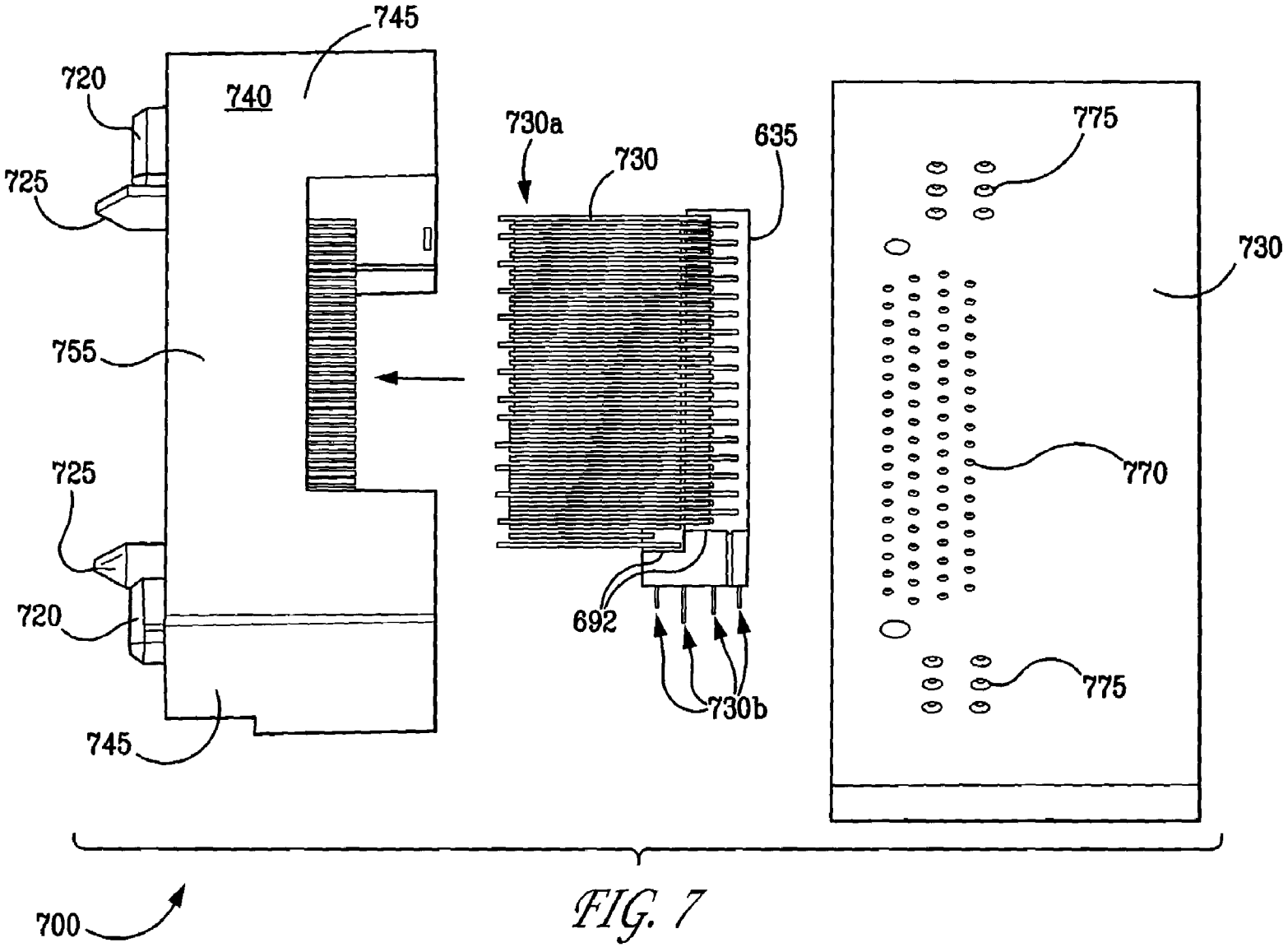
FIG. 7 shows one embodiment of a plug portion of a board-to-board connector system according to the invention adapted for thru-hole termination.

FIG. 7 shows one embodiment of a plug portion of a board-to-board connector system according to the invention adapted for thru-hole mount termination. As shown in FIG. 7, the plug portion 700 includes a main housing 740. As shown, the main housing 740 can include a power module sections 745 and a high speed contact section 755. The main housing can also include alignment pins 725 and a dielectric material 720 for utility contacts (not shown).

In accordance with one aspect of the invention, back housing 635, in addition to providing surface mount capabilities like that shown in FIG. 6, may also be used in a thru-hole configuration as shown in FIG. 7. Back housing 635 is adapted to secure the high speed contacts 730 within the main housing 740. In this manner, the high speed contacts 730 can be inserted into the back housing 735. The high speed contacts 730 can have one end 730A of the contact arranged in two rows and adapted for mating with complementary signal contacts in the receptacle portion (not shown) of the system. Any number of rows of contacts may be used without departing from the invention. Once the signal contacts 730 are secured in the slots 692 of back housing 635, the back housing 635 can be inserted into the main housing 740 by inserting the back housing 635 along direction D.

The high speed contacts 730 can also have end 730B arranged in four rows and adapted for thru-hole termination on printed circuit board 730. Any number of rows of contacts may be used without departing from the invention. As shown, the printed circuit board 730 may have signal thru-holes or vias 770 thereon such that electrical communication between the board 730 and the signal contacts 730 can be maintained. The printed circuit board 730 can also include utility contact thru-holes or vias 775 for thru-hole termination thereon such that electrical communication is established between the utility contacts (not shown) on plug 700 and the printed circuit board 730.

Figure 8A:
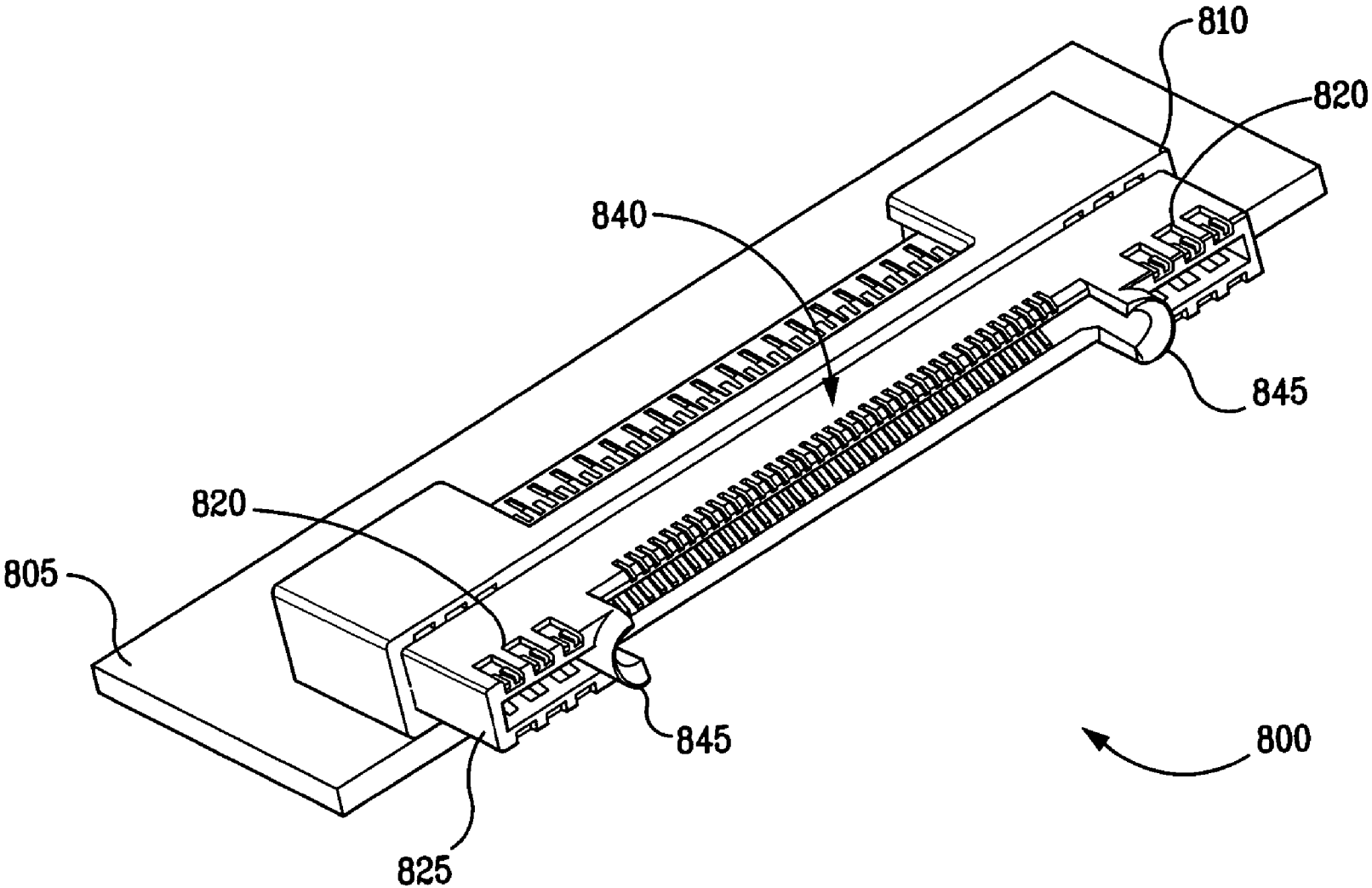
FIG. 8A shows one embodiment of a receptacle portion of a board-to-board connector system according to the invention.

FIG. 8A shows one embodiment of a receptacle portion of a board-to-board connector system according to the invention. As shown, receptacle 800 may be electrically connected to printed circuit board 805. Receptacle 800 includes a main housing 810. Main housing 810 can include a power module section 820 and a high speed contact section 840. Main housing 810 can also include alignment sockets 845. As stated above, alignment sockets 845 can include a chamfered tip for easier alignment.

Power module section 820 can include twelve utility contacts 825. The utility contacts 825 can be adapted to electrically connect to the utility contacts (not shown) of the plug portion (not shown).

Figure 8B:
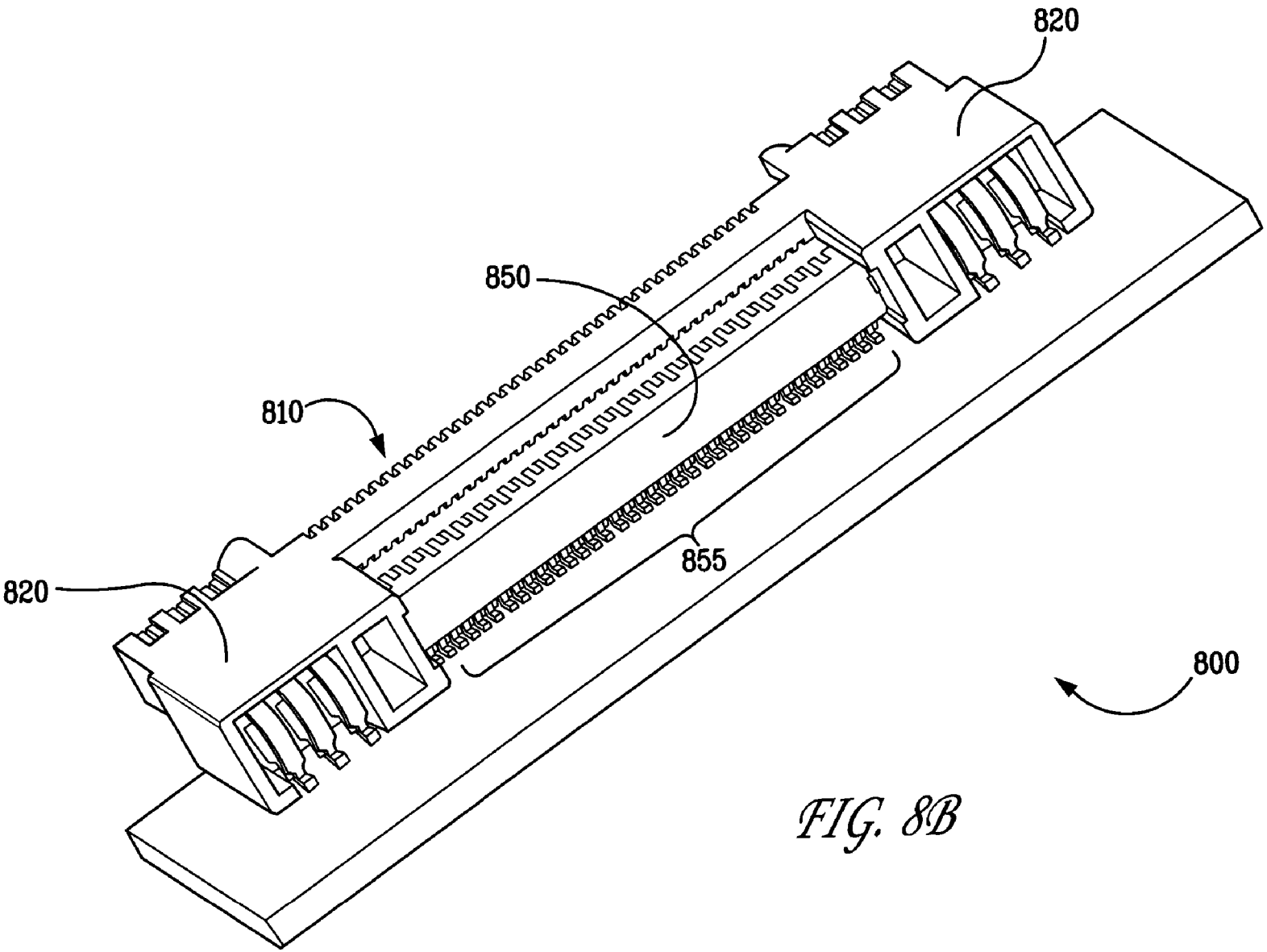
FIG. 8B shows a backview of the receptacle portion of FIG. 8A.

FIG. 8B shows a backview of the receptacle portion of FIG. 8A connected to printed circuit board 805. Like FIG. 8A, the receptacle portion 800 includes main housing 810. Also, receptacle portion 800 includes a back housing 850. Back housing 850 is adapted to secure high speed contacts 855 therein. The high speed contacts 855 are adapted to electrically connect to the high speed contacts (not shown) of the plug portion (not shown). The receptacle portion 800 also includes a power module section 820. The power module section can include utility contacts 825 adapted to electrically connect to the utility contacts (not shown) on the plug portion (not shown).

Figure 9:
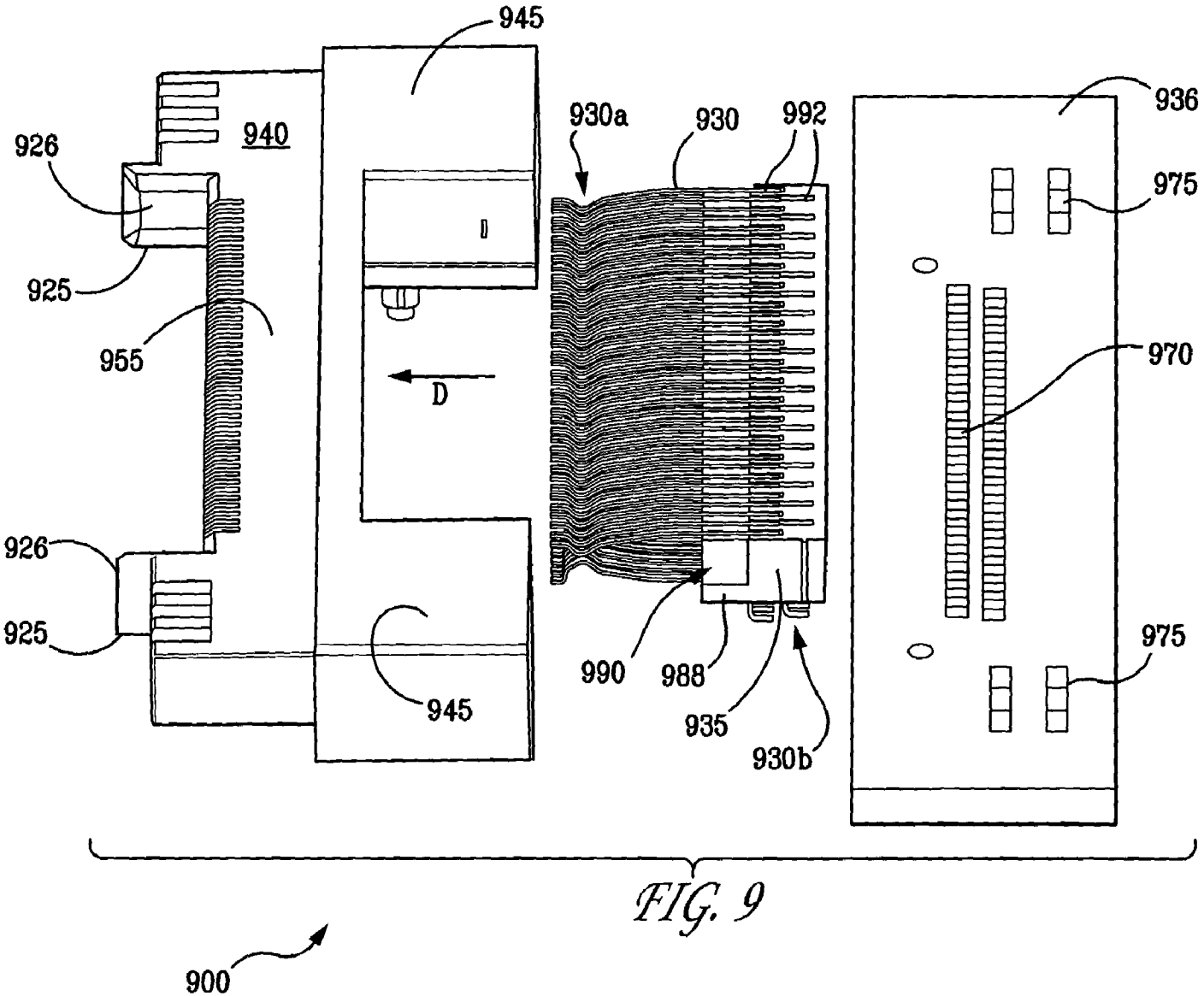
FIG. 9 shows one embodiment of a receptacle portion of a board-to-board connector system according to the invention adapted for surface mount termination.

FIG. 9 shows one embodiment of a receptacle portion of a board-to-board connector system according to the invention adapted for surface mount termination. FIG. 9 shows receptacle portion 900 adapted for surface mount termination. As shown, the receptacle portion 900 includes a main housing 940 and a back housing 935. As shown above, the main housing can include a power module sections 945 and a high speed contact section 955. The main housing can include alignment sockets 925 with chamfered ends 926.

The back housing 935 is adapted to secure the high speed contacts 930 within the main housing 940. In this manner, the high speed contacts 930 can be inserted into the back housing 935. In one embodiment, the back housing contains apertures or slots 992 in the housing through which the signal contacts 930 extend. The high speed contacts 930 can have one end 930A of the contact arranged in two rows and adapted for mating with complementary signal contacts in the plug portion (not shown) of the system. Also, in one embodiment of the invention, a back insert 990 may be used. In this manner, back insert 990 may mechanically mate with back housing 935. Specifically, back housing 935 may include a back housing lip 988 such that back insert 990 can abut thereto. Back insert 990 can help maintain spring tension and control wipe for signal contacts 930. Once the signal contacts 930 are secured in the back housing 935 and back insert 990, the back housing 935 and insert 990 can be inserted into the main housing 940 by inserting the back housing 935 along direction D.

The high speed contacts 930 can also have end 930B arranged in two rows and adapted for surface termination on printed circuit board 936. As shown, the printed circuit board 936 may have signal pads 970 thereon such that electrical communication between the board 936 and the signal contacts 930 can be maintained. The printed circuit board 936 can also include utility contact pads 975 for surface termination thereon such that electrical communication is established between the utility contacts (not shown) on plug 900 and the printed circuit board 936.

As can be seen in FIG. 9, the back housing 935 contains more slots 992 than necessary to provide a two row surface mount termination to board 936. In this manner, back housing 935 may be used in a different receptacle for a different connector that provides a different configuration or termination. Consequently, manufacturing costs may be reduced by providing a single back housing that can be used in different applications. For example, back housing 935 may be used in a receptacle like that shown in FIG. 10.

Figure 10:
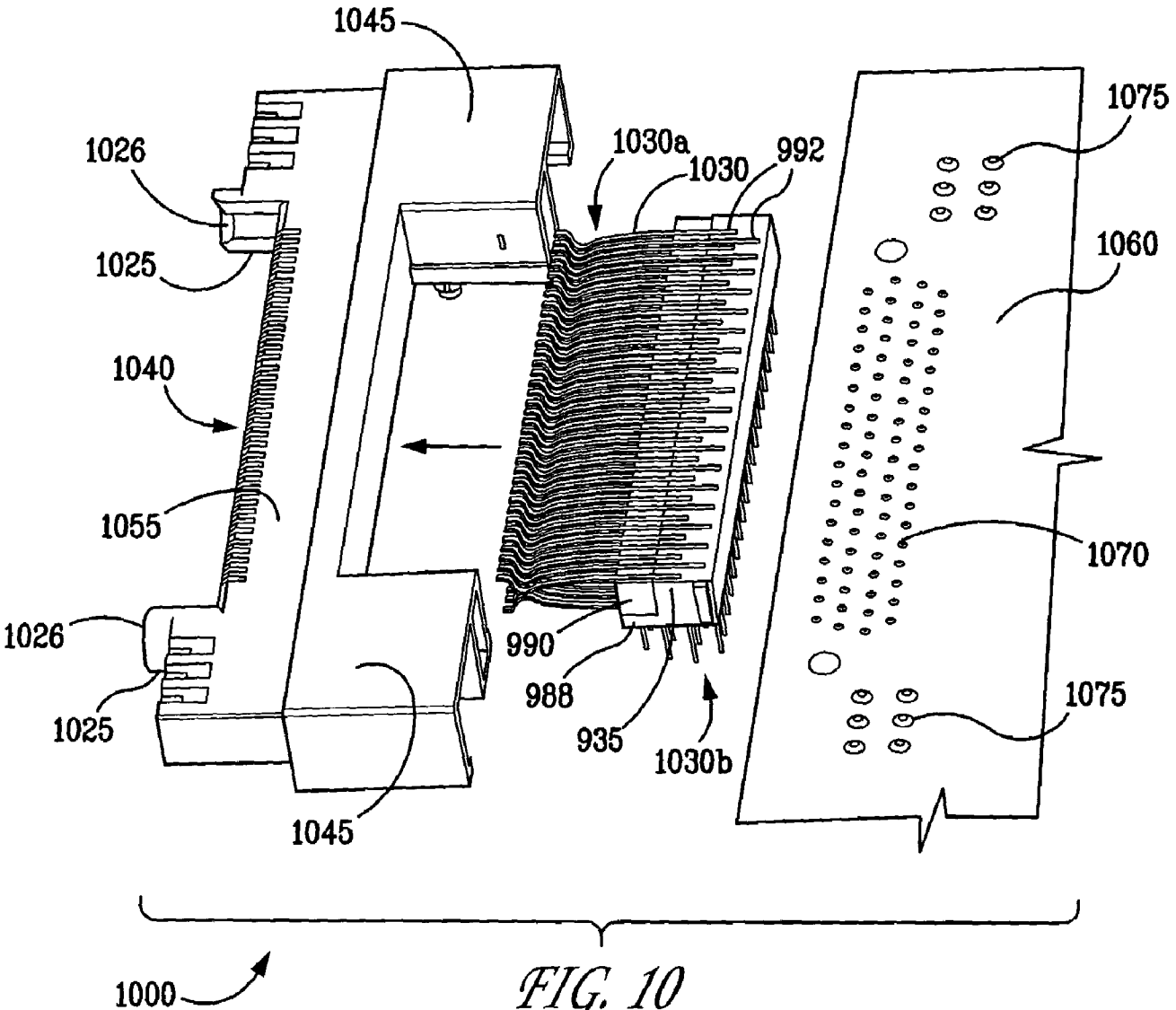
FIG. 10 shows one embodiment of a receptacle portion of a board-to-board connector system according to the invention adapted for thru-hole termination.

FIG. 10 shows one embodiment of a receptacle portion of a board-to-board connector system according to the invention adapted for thru-hole termination. Like the system of FIG. 9, as shown in FIG. 10, the receptacle portion 1000 includes a main housing 1040. As shown above, the main housing 1040 can include a power module sections 1045 and a high speed contact section 1055. The main housing 1040 can include alignment sockets 1025 with chamfered ends 1026.

In accordance with one aspect of the invention, back housing 935, in addition to providing surface mount capabilities like that shown in FIG. 9, may also be used in a thru-hole configuration as shown in FIG. 10. The back housing 935 is adapted to secure the high speed contacts 1030 within the main housing 1040. In this manner, the high speed contacts 1030 can be inserted into the back housing 935. The high speed contacts 1030 can have one end 1030A of the contact arranged in two rows and adapted for mating with complementary signal contacts in the plug portion (not shown) of the system. Also, in one embodiment of the invention, a back insert 990 may be used. In this manner, back insert 990 may mechanically mate with back housing 1035. Specifically, back housing 935 may include a back housing lip 988 such that back insert 990 can abut thereto. Back insert 990 can help maintain spring tension and control wipe for signal contacts 1030. Once the signal contacts 1030 are secured in the back housing 1035, the back housing 935 can be inserted into the main housing 1040 by inserting the back housing 935 along direction D.

The high speed contacts 1030 can also have end 1030B arranged in four rows and adapted for thru-hole termination on printed circuit board 1060. As shown, the printed circuit board 1060 may have signal thru-holes or vias 1070 thereon such that electrical communication between the board 1060 and the signal contacts 1030 can be maintained. The printed circuit board 1060 can also include utility contact vias 1075 for thru-hole termination such that electrical communication is established between the utility contacts (not shown) on receptacle 1000 and the printed circuit board 1060

Figure 11:
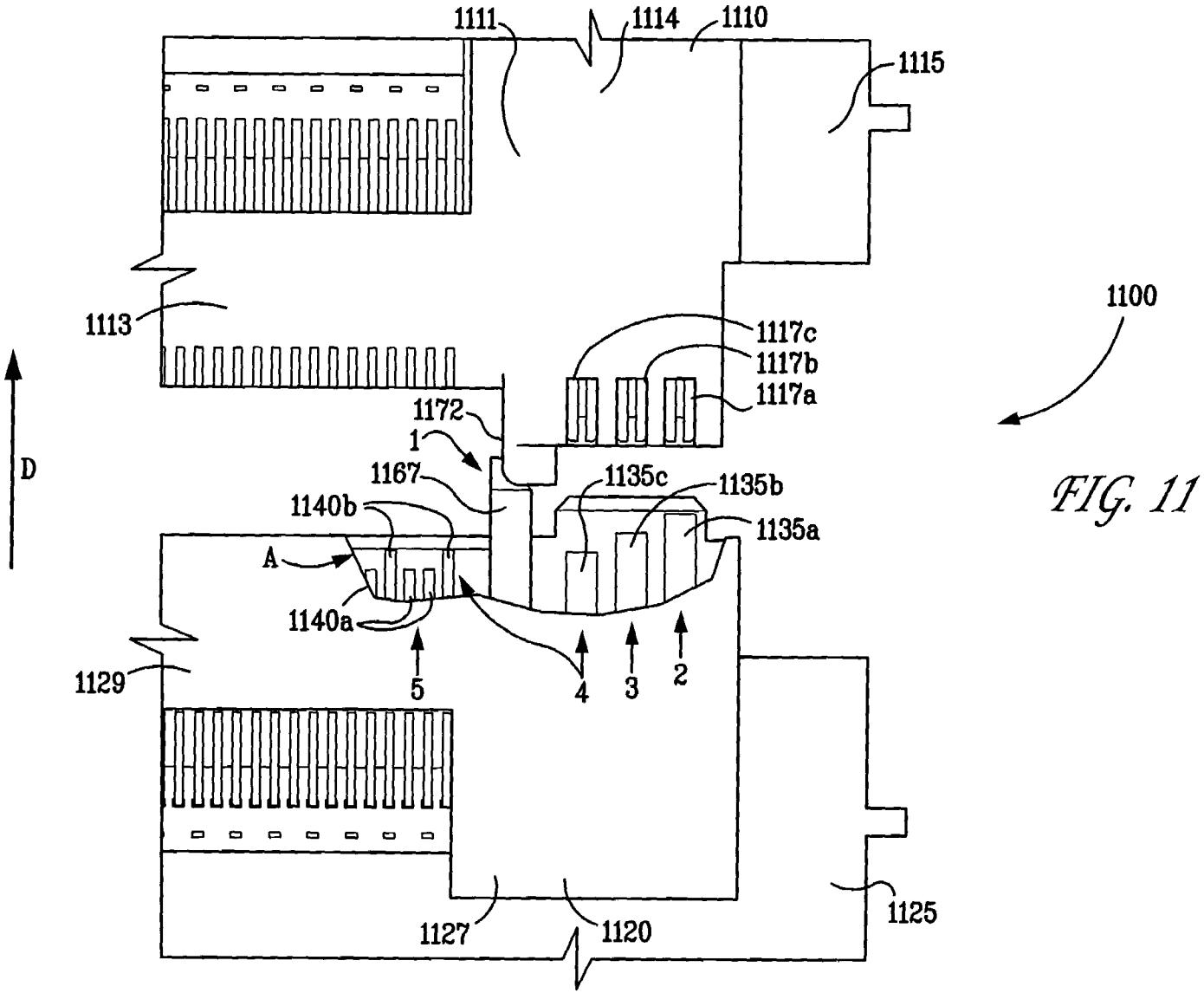
FIG. 11 shows the contact sequencing of one embodiment of the invention when the receptacle and plug portions are mated.

FIG. 11 shows the contacts sequencing of one embodiment of the invention when the receptacle and plug portions are mated in direction D. Board to Board system 1100 is shown having a receptacle portion 1110 attached to a printed circuit board 1115 and a plug portion 1120 attached to a printed circuit board 1125. Receptacle portion 1110 includes a main housing 1114 having a power module section 1111 and a high speed contact section 1113. Power module section 1111 includes utility contacts 1117.

Plug portion 1120 includes a main housing 1127 having a high speed contacts section 1129 and a power module section 1128. Portion A of the main housing 1127 has been cut away for illustration purposes. As can be seen in portion A, the power module section 1128 includes three utility contacts 1135 A–C. Also in portion A, the high speed contacts section includes signal contacts 1140A and ground contacts 1140B. As shown, in one embodiment of the invention, the signal contacts 1140A and ground contacts 1140 are arranged in a signal-signal-ground configuration. However, any configuration of the ground contacts and signal contacts may be used without departing from the principles of the present invention.

When the receptacle portion 1110 and plug portion 1120 are mated together, the first in the contact sequence 1 between the plug 1120 and the receptacle 1110 is the mating of the alignment pin 1167 on the plug portion 1120 and the alignment socket 1172 on the receptacle portion 1110. In this manner, the mating of alignment pin 1167 and socket 1172 aid in accurately aligning the complementary contacts on the plug and the receptacle. As discussed above, the alignment pins and alignment socket may be chamfered to allow easier mating.

Next, the first utility contact pair 2 may be mated. Specifically, utility contact 1135A of plug 1120 mates with utility contact 1117A of receptacle 1110. Utility contacts 1135A and 1117A may be, for example, an electrostatic discharge contact or a power ground contact. In one embodiment of the invention, once the alignment pin 1167 has been inserted 7 mm into the alignment socket, then contact is made between utility contact 1135A and utility contact 1117A. However, it should be understood that distance may vary without departing from the invention.

Next, the second utility contact pair 3 may be mated. Specifically, utility contact 1135B of plug 1120 mates with utility contact 1117B of receptacle 1110. Utility contacts 1135B and 1117B may be an electrostatic discharge contact or a ground contact. In one embodiment of the invention, once the utility contact 1135A has been coupled with contact 1117A for a distance of 1 mm, then contact is made between utility contact 1135B and utility contact 1117B. However, it should be understood that distance may vary without departing from the invention.

Next, the third utility contact pair and ground contacts 1140B are mated. Specifically, utility contact 1135C and utility contact 1117C are mated. At the same time, ground contacts 1140B on the plug portion 1120 are mated with ground contacts (not shown) on the receptacle 1110. In one embodiment of the invention, once the utility contact 1135B has been coupled with contact 1117B for a distance of 1 mm, then contact is made between utility contact 1135C and utility contact 1117C and ground contact 1140B on the plug portion 1120 and the ground contact (not shown) on the receptacle portion 1110. However, it should be understood that the distance may vary without departing from the invention.

Finally, the high speed contacts 1140A of the plug portion 1120 are mated with the high speed contacts (not shown) on the receptacle portion 1110. In one embodiment of the invention, once the utility contact 1135C has been coupled with contact 1117C for a distance of 1 mm, then contact is made between the signal contacts 1140A on the plug 1120 and the signal contacts (not shown) on the receptacle 1110. However, it should be understood that the distance may vary without departing from the invention.

As can be seen from FIG. 11, the contact sequencing is dependent upon the relative proximity of the contacts to the complementary portion of the system. In this manner, the absolute distance between the contacts in the plug portion and the receptacle portion may change without departing from the invention. Further, the relative distance between the contacts within each of the plug portion and the receptacle portion may change without departing from the invention.

Figure 12A:
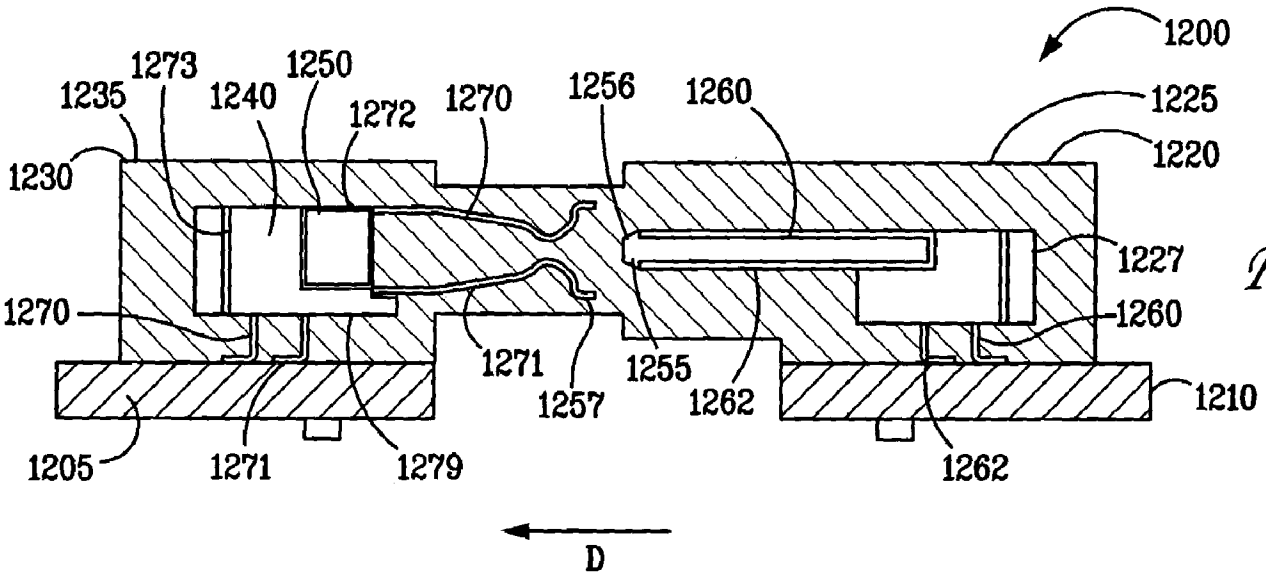
FIG. 12A shows a side view of the high speed contacts section of a partially mated plug portion and receptacle portion according to the invention.

FIG. 12A shows a side view of the high speed contacts section of a partially mated plug portion and receptacle portion of the invention. The connector system 1200 includes a plug portion 1220 connected to circuit board 1210 and a receptacle portion 1230 connected to board 1205. The plug 1220 includes a main housing 1225 and a back housing 1227. The receptacle portion 1230 includes a main housing 1235, back housing 1240 and a back insert 1250.

In one embodiment of the invention, and as seen in FIG. 12A, the high speed contacts section of the connector system can use blade on beam technology. In this manner, the plug portion 1220 may include a beam 1255 having a top surface 1256 and a bottom surface 1257. Preferably, beam 1255 is made from any suitable non-conductive material. Signal contacts 1260 and 1262 are positioned on the beam 1255. Specifically, signal contact 1260 is placed on the top surface 1256 of the beam 1255 and signal contact 1262 is placed on the bottom surface 1257 of the beam 1255. Signal contact 1260 extends along the surface 1256 of the beam 1257 through the back housing 1227 and is electrically connected to the printed circuit board The receptacle portion 1230 may include dual beam receptacle signal contacts 1270 and 1271. Signal contact 1270 extends along the top surface 1272 of back insert 1250 and the top surface 1273 of back housing 1240. Signal contact 1270 is then electrically connected to circuit board 1205. In one embodiment, back insert 1250 is positioned on back housing lip 1279. In this manner, signal contact 1271 extends between back insert 1250 and back housing 1240 in the proximity of back housing lip 1279. Signal contact 1271 is then electrically connected to printed circuit board 1205.

After plug 1225 is moved in direction D, the receptacle 1230 and plug can be fully mated. Once fully mated, signal contact 1270 in receptacle 1230 contacts signal contact 1260 in plug 1220. Additionally, once fully mated, signal contact 1271 in receptacle 1250 contacts signal contact 1262 in plug 1220. Thereafter, electrical communication exists between printed circuit board 1205 and printed circuit board 1210.

Figure 12B:
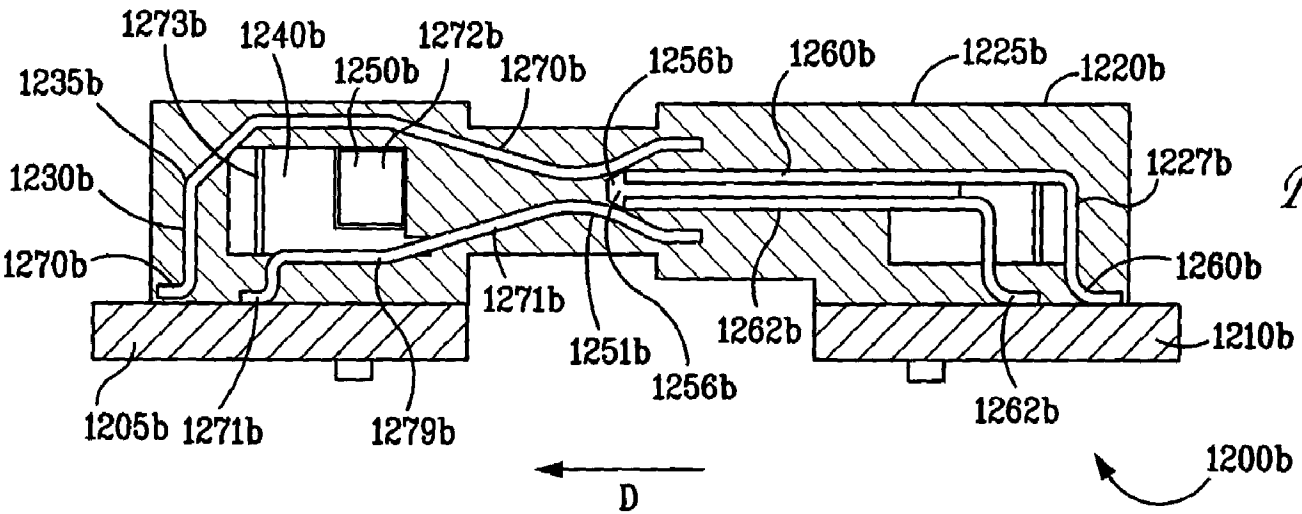
FIG. 12B shows a side view of the utility contacts section of a partially mated plug portion and receptacle portion according to the invention.

FIG. 12B shows a side view of the utility contacts or power module section of a partially mated plug portion and receptacle portion of the invention. The connector system 1200B includes a plug portion 1220B connected to circuit board 1210B and a receptacle portion 1230B connected to board 1205. The plug 1220B includes a main housing 1225B and a back housing 1227B. The receptacle portion 1230B includes a main housing 1235B, back housing 1240B and a back insert 1250B.

In one embodiment of the invention, and as seen in FIG. 12B, the power module section can use blade on beam technology. In this manner, the plug portion 1220B may include a beam 1255B having a top surface 1256B and a bottom surface 1257B. Preferably, beam 1255B is made from any suitable non-conductive material. Utility signal contacts 1260B and 1262B are positioned on the beam 1255B. Specifically, utility signal contact 1260B is placed on the top surface 1256B of the beam 1255B and signal contact 1262B is placed on the bottom surface 1257B of the beam 1255B. Utility signal contact 1260B extends along the surface 1256B of the beam 1257B through the back housing 1227B and is electrically connected to the printed circuit board.

The receptacle portion 1230B may include dual beam receptacle utility signal contacts 1270B and 1271B. Utility signal contact 1270B extends along the top surface 1272B of back insert 1250B and the top surface 1273B of back housing 1240B. Utility signal contact 1270B is then electrically connected to circuit board 1205B. In one embodiment, back insert 1250B is positioned on back housing lip 1279B. In this manner, utility signal contact 1271B extends between back insert 1250B and back housing 1240B in the proximity of back housing lip 1279B. Utility signal contact 1271B is then electrically connected to printed circuit board 1205B.

After plug 1225B is moved in direction D, the receptacle 1230B and plug can be fully mated. Once fully mated, utility signal contact 1270B in receptacle 1230B contacts utility signal contact 1260B in plug 1220B. Additionally, once fully mated, utility signal contact 1271B in receptacle 1250B contacts signal contact 1262B in plug 1220B. Thereafter, electrical communication exists between printed circuit board 1205B and printed circuit board 1210B.

It is to be understood that the foregoing illustrative embodiments have been provided merely for the purpose of explanation and are in no way to be construed as limiting of the invention. Words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

What is claimed:

1. A high speed electrical connector comprising:

a back housing;

a first portion comprising a first plurality of contacts received in the back housing, each contact of the first plurality of contacts defining a first terminal end and a second terminal end, the first terminal ends of the first plurality of contacts arranged in a first configuration for a first type of termination to a first substrate and the second terminal ends of the first plurality of contacts arranged in a second configuration, wherein each second terminal end is adapted to mate with a respective contact of a second electrical connector;

wherein the back housing is adapted to be received in a third electrical connector and to contain a second plurality of contacts, each contact of the second plurality of contacts defining a third terminal end and a fourth terminal end, the third terminal ends of the second plurality of contacts arranged in a third configuration for a second type of termination to a second substrate and the fourth terminal ends of the second plurality of contacts arranged in the second configuration, wherein each fourth terminal end is adapted to mate with a respective contact of the second electrical connector.

2. The connector of claim 1 further comprising a receptacle insert housing.

3. The connector of claim 1 further comprising a plurality of utility contacts contained in the first portion.

4. The connector of claim 1 wherein the first plurality of contacts is arranged in a signal signal ground configuration.

5. The connector of claim 1 further comprising an alignment pin on the first portion that aligns with an alignment socket of a second portion of the electrical connector.

6. The connector of claim 1 further comprising a blade portion in the first portion.

7. The connector of claim 1 wherein the first plurality of contacts are dual beam contacts.

8. The electrical connector of claim 1, wherein the first portion is a first plug portion.

9. The electrical connector of claim 1, wherein the first portion is a first receptacle portion.

10. The electrical connector of claim 1, wherein the first type of termination and the second type of termination are the same.

11. The connector of claim 5 wherein the alignment pin has a chamfered tip.

12. A high speed electrical connector system comprising:

a plug portion comprising a plug back housing and a first plurality of contacts, each contact of the first plurality of contacts extending through a respective slot of a first plurality of slots in the plug back housing, each contact of the first plurality of contacts defining a first terminal end and a second terminal end, wherein the first terminal ends of the first plurality of contacts are arranged in a first configuration and are adapted for a first type of termination to a first printed circuit board; and a receptacle portion comprising a receptacle back housing and a second plurality of contacts, each contact of the second plurality of contacts extending through a respective slot of a second plurality of slots in the receptacle back housing, each contact of the second plurality of contacts defining a third terminal end and a fourth terminal end, wherein the third terminal ends of the second plurality of contacts are arranged in a second configuration and are adapted for the first type of termination to a second printed circuit board;

wherein the second terminal ends of the first plurality of contacts in the plug portion are arranged in a third configuration and the fourth terminal ends of the second plurality of contacts in the receptacle portion are arranged in a fourth configuration;

wherein each second terminal end in the plug portion is adapted to mate with a respective fourth terminal end in the receptacle portion;

wherein at least one of the plug back housing and the receptacle back housing further comprises a third plurality of slots adapted to contain a third plurality of contacts, each contact of the third plurality of contacts defining a fifth terminal end and a sixth terminal end, wherein the fifth terminal ends of the third plurality of contacts are arranged in a fifth configuration and are adapted for a second type of termination to a third printed circuit board, and wherein the sixth terminal ends of the third plurality of contacts are arranged in at least one of the third configuration and the fourth configuration.

13. The connector system of claim 12 further comprising a receptacle insert housing.

14. The connector system of claim 12 further comprising a first plurality of utility contacts contained in the plug portion and a second plurality of utility contacts contained in the receptacle portion.

15. The connector system of claim 12 wherein the first and second plurality of contacts are both arranged in a signal signal ground configuration.

16. The connector system of claim 12 further comprising an alignment pin on the plug portion and an alignment socket on the receptacle portion.

17. The connector system of claim 12 further comprising a blade portion in the plug portion.

18. The connector system of claim 12 wherein the second plurality of contacts are dual beam contacts.

19. The electrical connector system of claim 12, wherein the first type of termination is through-hole termination and the second type of termination is surface mount termination.

20. The connector system of claim 16 wherein the alignment pin has a chamfered tip.

21. A high speed electrical connector system comprising:

a first portion including a first back housing, the first back housing comprising a first plurality of slots and a first plurality of contacts, each contact of the first plurality of contacts extending through a respective slot of the first plurality of slots and defining a first terminal end and a second terminal end, wherein the first terminal ends of the first plurality of contacts are arranged in a first configuration and are adapted for thru-hole termination, wherein the first back housing also comprises a second plurality of slots configured to secure a second plurality of contacts, each contact of the second plurality of contacts defining a third terminal end and a fourth terminal end, wherein the third terminal ends of the second plurality of contacts are arranged in a second configuration and are adapted for surface mount termination; and a second portion adapted to mate with the first portion;

wherein the second terminal ends and the fourth terminal ends in the first portion are each arranged in a third configuration.

* * * * *